US008161674B2

(12) United States Patent
Holmberg

(10) Patent No.: US 8,161,674 B2
(45) **Date of Patent: *Apr. 24, 2012**

(54) ELECTRONIC DEVICE MOUNT SYSTEM WITH STRAP

(76) Inventor: Larry Holmberg, Harrisburg, SD (US)

( * ) Notice: Subject to any disclaimer, the term of this patent is extended or adjusted under 35 U.S.C. 154(b) by 231 days.

This patent is subject to a terminal disclaimer.

(21) Appl. No.: 12/456,366

(22) Filed: Jun. 16, 2009

(65) Prior Publication Data

US 2010/0313461 A1 Dec. 16, 2010

(51) Int. Cl.
*F41G 1/38* (2006.01)

(52) U.S. Cl. ..... 42/90; 42/124

(58) Field of Classification Search ..... 42/90, 111, 42/97, 106, 124; 89/37; 108/2
See application file for complete search history.

(56) References Cited

U.S. PATENT DOCUMENTS

| | | | | | |
|---|---|---|---|---|---|
| 521,761 | A | | 6/1894 | Day | |
| 547,912 | A | | 10/1895 | Crupe | |
| 619,214 | A | | 2/1899 | Paul | |
| 674,229 | A | | 5/1901 | Windle | |
| 845,165 | A | | 2/1907 | Davis | |
| 899,639 | A | | 9/1908 | Vibber | |
| 1,452,651 | A | | 4/1923 | Norrlin | |
| 1,480,147 | A | | 1/1924 | Brandt | |
| 1,550,849 | A | * | 8/1925 | Szalardi | 396/426 |
| 1,735,164 | A | | 11/1929 | Green | |
| 1,757,244 | A | | 5/1930 | Green | |
| 1,923,926 | A | * | 8/1933 | Faure-Roux | 267/69 |
| 2,072,387 | A | * | 3/1937 | Sneed | 87/6 |
| 2,101,479 | A | | 12/1937 | Schenk | |
| 2,129,606 | A | * | 9/1938 | Nisenson | 160/168.1 R |
| 2,270,902 | A | * | 1/1942 | Rubissow | 267/141 |
| 2,296,308 | A | * | 9/1942 | Rand | 116/325 |
| 2,354,998 | A | * | 8/1944 | Ku | 248/454 |
| 2,416,769 | A | * | 3/1947 | Palmer | 396/426 |
| 2,450,466 | A | | 10/1948 | Carlson | |
| 2,456,554 | A | * | 12/1948 | Churchill | 403/212 |
| 2,483,711 | A | | 10/1949 | Roos | |
| 2,576,007 | A | * | 11/1951 | Fischer et al. | 42/126 |
| 2,604,933 | A | | 7/1952 | Karg | |

(Continued)

FOREIGN PATENT DOCUMENTS

EP 1804017 A1 7/2007

(Continued)

OTHER PUBLICATIONS

Improved Construction Methods, "Laser Measuring System, Impulse LX", http://www.improvedconstructionmethods.com/impulse_xl.htm.

(Continued)

*Primary Examiner* — Michael Carone
*Assistant Examiner* — Joshua Freeman
(74) *Attorney, Agent, or Firm* — Kinney & Lange, P.A.

(57) ABSTRACT

An electronic device mounting system can be used to attach electronic devices, such as rangefinders and video cameras, to weapons. The mounting system includes a support portion for resiliently supporting the electronic device and a mounting portion for attaching the support portion and attached electronic device to a weapon. The support portion is universal in that it can be used with a number of interchangeable mounting portions. Each mounting portion is adapted for securing the support portion to a particular type of weapon or weapon accessory.

20 Claims, 6 Drawing Sheets

U.S. PATENT DOCUMENTS

| | | | | | |
|---|---|---|---|---|---|
| 2,664,797 | A | | 1/1954 | Thrasher | |
| 2,814,118 | A | | 11/1957 | Evans et al. | |
| 2,817,233 | A | * | 12/1957 | Dower et al. | 73/167 |
| 2,943,547 | A | * | 7/1960 | Martin | 396/426 |
| 3,035,880 | A | | 5/1962 | Hitchcock | |
| 3,062,114 | A | | 11/1962 | Palos | |
| 3,065,666 | A | | 11/1962 | Sampson | |
| 3,078,728 | A | | 2/1963 | Schlesman | |
| 3,165,972 | A | | 1/1965 | Cumbo | |
| 3,371,899 | A | * | 3/1968 | Johnson | 410/88 |
| 3,427,102 | A | | 2/1969 | Wade | |
| 3,483,623 | A | | 12/1969 | Kruzell | |
| 3,502,062 | A | | 3/1970 | Shurts | |
| 3,545,356 | A | | 12/1970 | Nielsen | |
| 3,684,376 | A | | 8/1972 | Lessard | |
| 3,684,378 | A | | 8/1972 | Lord | |
| 3,737,232 | A | | 6/1973 | Millburn, Jr. | |
| 3,782,822 | A | | 1/1974 | Spence | |
| 3,785,261 | A | | 1/1974 | Ganteaume | |
| 3,834,052 | A | | 9/1974 | Steck, III | |
| 3,945,134 | A | | 3/1976 | Ramer | |
| 3,986,285 | A | | 10/1976 | Krisay | |
| 4,000,403 | A | | 12/1976 | Rice | |
| 4,026,054 | A | | 5/1977 | Snyder | |
| 4,027,414 | A | | 6/1977 | Felix | |
| 4,069,414 | A | | 1/1978 | Bell | |
| 4,162,696 | A | | 7/1979 | Sprung | |
| 4,223,770 | A | | 9/1980 | Kranz | |
| 4,234,112 | A | * | 11/1980 | Gallant | 224/559 |
| 4,283,743 | A | | 8/1981 | Kaiser | |
| T101,001 | I4 | | 9/1981 | Shipp et al. | |
| D261,545 | S | | 10/1981 | Holmberg | |
| 4,296,725 | A | | 10/1981 | Broderick | |
| 4,309,095 | A | * | 1/1982 | Buckley | 396/420 |
| 4,316,342 | A | | 2/1982 | Griggs | |
| 4,349,169 | A | | 9/1982 | McAnally | |
| D268,910 | S | | 5/1983 | Shipp et al. | |
| 4,439,032 | A | | 3/1984 | Congdon | |
| 4,514,907 | A | | 5/1985 | Saltzman | |
| 4,516,296 | A | | 5/1985 | Sherman | |
| 4,531,052 | A | | 7/1985 | Moore | |
| 4,561,204 | A | | 12/1985 | Binion | |
| 4,564,322 | A | | 1/1986 | Stapley | |
| 4,597,211 | A | | 7/1986 | Miles | |
| 4,606,629 | A | | 8/1986 | Hines et al. | |
| 4,617,741 | A | | 10/1986 | Bordeaux et al. | |
| 4,640,258 | A | | 2/1987 | Penney et al. | |
| 4,643,159 | A | | 2/1987 | Ryan | |
| 4,730,190 | A | | 3/1988 | Win et al. | |
| 4,753,528 | A | | 6/1988 | Hines et al. | |
| 4,777,352 | A | | 10/1988 | Moore | |
| 4,786,204 | A | | 11/1988 | Mayeda | |
| 4,786,966 | A | | 11/1988 | Hanson et al. | |
| 4,827,348 | A | | 5/1989 | Ernest et al. | |
| 4,835,621 | A | | 5/1989 | Black | |
| 4,884,137 | A | | 11/1989 | Hanson et al. | |
| 4,890,128 | A | | 12/1989 | Kania | |
| 4,907,567 | A | | 3/1990 | Henrich | |
| 4,910,717 | A | | 3/1990 | Terry | |
| 4,939,863 | A | | 7/1990 | Alexander et al. | |
| 4,970,589 | A | | 11/1990 | Hanson et al. | |
| 4,974,575 | A | | 12/1990 | Mitchell | |
| D313,361 | S | | 1/1991 | Robinson | |
| 4,989,024 | A | | 1/1991 | Myers | |
| 4,993,833 | A | | 2/1991 | Lorey et al. | |
| 4,996,866 | A | | 3/1991 | Masera et al. | |
| 5,005,213 | A | | 4/1991 | Hanson et al. | |
| 5,020,262 | A | | 6/1991 | Pena | |
| 5,026,158 | A | | 6/1991 | Golubic | |
| 5,033,219 | A | | 7/1991 | Johnson et al. | |
| 5,035,390 | A | * | 7/1991 | Sanders | 248/229.17 |
| 5,056,410 | A | * | 10/1991 | Pitts | 89/37.04 |
| 5,113,745 | A | * | 5/1992 | Allen | 89/14.05 |
| 5,121,147 | A | | 6/1992 | Wada et al. | |
| 5,161,310 | A | | 11/1992 | Stoot | |
| 5,200,827 | A | | 4/1993 | Hanson et al. | |
| 5,244,430 | A | * | 9/1993 | Legursky | 446/397 |
| 5,262,837 | A | | 11/1993 | Shyy | |
| 5,265,896 | A | | 11/1993 | Kravitz | |
| 5,297,533 | A | | 3/1994 | Cook | |
| 5,326,061 | A | | 7/1994 | Hamilton | |
| 5,339,793 | A | | 8/1994 | Findley | |
| 5,373,657 | A | | 12/1994 | Betz et al. | |
| 5,418,609 | A | | 5/1995 | Dunne | |
| 5,450,993 | A | * | 9/1995 | Guerrero et al. | 224/246 |
| 5,455,625 | A | | 10/1995 | Englander | |
| 5,456,157 | A | | 10/1995 | Lougheed et al. | |
| 5,479,712 | A | | 1/1996 | Hargrove et al. | |
| 5,507,272 | A | | 4/1996 | Scantlen | |
| 5,520,164 | A | | 5/1996 | Huddleston | |
| D371,084 | S | | 6/1996 | Ogawa | |
| 5,528,325 | A | | 6/1996 | Perez | |
| 5,531,149 | A | | 7/1996 | Schubert et al. | |
| 5,555,665 | A | | 9/1996 | Fore | |
| 5,575,072 | A | | 11/1996 | Eldridge | |
| 5,606,818 | A | | 3/1997 | Hardee | |
| 5,607,091 | A | * | 3/1997 | Musacchia | 224/222 |
| 5,611,324 | A | | 3/1997 | Kursinsky | |
| 5,669,147 | A | | 9/1997 | Nakajima et al. | |
| 5,669,174 | A | | 9/1997 | Teetzel | |
| 5,686,690 | A | | 11/1997 | Lougheed et al. | |
| 5,687,910 | A | | 11/1997 | King | |
| 5,711,104 | A | | 1/1998 | Schmitz | |
| D390,483 | S | | 2/1998 | Zykan et al. | |
| 5,739,859 | A | | 4/1998 | Hattori et al. | |
| 5,811,720 | A | * | 9/1998 | Quinnell et al. | 89/37.04 |
| 5,815,251 | A | | 9/1998 | Ehbets et al. | |
| 5,822,621 | A | | 10/1998 | Szajewski | |
| 5,831,718 | A | | 11/1998 | Desai et al. | |
| 5,834,676 | A | | 11/1998 | Elliott | |
| 5,845,165 | A | | 12/1998 | McMahan | |
| 5,859,693 | A | | 1/1999 | Dunne et al. | |
| 5,887,375 | A | | 3/1999 | Watson | |
| 5,892,617 | A | | 4/1999 | Wallace | |
| 5,895,131 | A | | 4/1999 | Yano | |
| 5,911,215 | A | | 6/1999 | Fisher, Jr. | |
| 5,926,260 | A | | 7/1999 | Dunne et al. | |
| 5,937,562 | A | | 8/1999 | Brough | |
| 5,941,434 | A | * | 8/1999 | Green | 224/250 |
| 5,944,041 | A | | 8/1999 | Kitchens | |
| 5,949,529 | A | | 9/1999 | Dunne et al. | |
| 5,963,748 | A | | 10/1999 | Glasson | |
| 5,964,054 | A | | 10/1999 | Galfidi, Jr. | |
| 5,973,315 | A | | 10/1999 | Saldana et al. | |
| D421,229 | S | | 2/2000 | Imai | |
| 6,029,643 | A | | 2/2000 | Golfieri | |
| 6,070,355 | A | | 6/2000 | Day | |
| 6,073,352 | A | | 6/2000 | Zykan et al. | |
| D432,930 | S | | 10/2000 | Sanoner | |
| 6,137,564 | A | | 10/2000 | Schmidt et al. | |
| 6,154,971 | A | | 12/2000 | Perkins | |
| 6,192,614 | B1 | * | 2/2001 | Cliburn | 42/106 |
| 6,252,706 | B1 | | 6/2001 | Kaladgew | |
| 6,269,581 | B1 | | 8/2001 | Groh | |
| 6,286,796 | B1 | * | 9/2001 | Pugliesi | 248/187.1 |
| 6,288,386 | B1 | | 9/2001 | Bowen et al. | |
| 6,296,581 | B1 | | 10/2001 | Sever | |
| 6,304,289 | B1 | | 10/2001 | Sakai et al. | |
| 6,331,887 | B1 | | 12/2001 | Shiraishi et al. | |
| 6,336,285 | B1 | | 1/2002 | Baumer | |
| 6,341,201 | B1 | | 1/2002 | Ishiguro et al. | |
| 6,396,571 | B2 | | 5/2002 | Ohtomo et al. | |
| 6,397,483 | B1 | | 6/2002 | Perkins | |
| 6,398,571 | B1 | | 6/2002 | Nishide et al. | |
| 6,408,140 | B1 | | 6/2002 | Malloy Desormeaux | |
| D460,367 | S | | 7/2002 | Apotheloz et al. | |
| D460,368 | S | | 7/2002 | Apotheloz et al. | |
| D460,369 | S | | 7/2002 | Apotheloz et al. | |
| 6,425,697 | B1 | | 7/2002 | Potts et al. | |
| 6,450,816 | B1 | | 9/2002 | Gerber | |
| 6,487,809 | B1 | | 12/2002 | Gaber | |
| 6,494,196 | B2 | | 12/2002 | Harwath et al. | |
| 6,526,956 | B1 | | 3/2003 | Hankins | |
| D472,826 | S | | 4/2003 | Sanoner | |
| 6,556,245 | B1 | | 4/2003 | Holmberg | |
| 6,598,331 | B1 | | 7/2003 | Thibodeaux | |
| 6,615,531 | B1 | | 9/2003 | Holmberg | |

| | | | | |
|---|---|---|---|---|
| 6,623,182 | B2 | 9/2003 | Tatera | |
| 6,624,881 | B2 | 9/2003 | Waibel et al. | |
| 6,678,988 | B1 * | 1/2004 | Poff, Jr. | 42/147 |
| 6,681,755 | B2 | 1/2004 | Pujos | |
| 6,693,702 | B2 | 2/2004 | Rogers | |
| 6,704,097 | B2 | 3/2004 | Waibel et al. | |
| D488,315 | S | 4/2004 | Natuzzi | |
| 6,722,076 | B2 | 4/2004 | Nielsen | |
| 6,742,299 | B2 | 6/2004 | Strand | |
| 6,772,076 | B2 | 8/2004 | Yamamoto et al. | |
| 6,784,920 | B2 | 8/2004 | Weber | |
| 6,796,038 | B2 | 9/2004 | Humphries | |
| 6,813,025 | B2 | 11/2004 | Edwards | |
| 6,815,251 | B1 | 11/2004 | Akram et al. | |
| 6,819,495 | B2 | 11/2004 | Shani et al. | |
| 6,819,866 | B2 | 11/2004 | Da Silva | |
| 6,886,288 | B1 | 5/2005 | Yocum et al. | |
| 6,932,305 | B2 | 8/2005 | Morales et al. | |
| 6,988,331 | B2 | 1/2006 | Holmberg | |
| 7,088,506 | B2 | 8/2006 | Regan et al. | |
| 7,128,354 | B2 | 10/2006 | Wu | |
| 7,188,978 | B2 | 3/2007 | Sharrah et al. | |
| 7,269,920 | B2 | 9/2007 | Staley, III | |
| 7,390,130 | B2 | 6/2008 | Soulvie | |
| 7,594,352 | B2 * | 9/2009 | Holmberg | 42/124 |
| 7,614,805 | B2 | 11/2009 | Showalter | |
| 7,789,574 | B2 | 9/2010 | Broberg | |
| 8,024,884 | B2 * | 9/2011 | Holmberg | 42/124 |
| 2001/0018311 | A1 * | 8/2001 | Musacchia | 446/418 |
| 2001/0035440 | A1 * | 11/2001 | Danielson | 224/149 |
| 2002/0067475 | A1 | 6/2002 | Waibel et al. | |
| 2002/0078577 | A1 | 6/2002 | Aldred | |
| 2002/0087475 | A1 | 7/2002 | Okayama et al. | |
| 2002/0109057 | A1 | 8/2002 | Wooten et al. | |
| 2002/0171755 | A1 | 11/2002 | Nishimura | |
| 2003/0013392 | A1 | 1/2003 | Guillermin | |
| 2003/0133092 | A1 | 7/2003 | Rogers | |
| 2003/0163943 | A1 | 9/2003 | Holmberg | |
| 2003/0168484 | A1 * | 9/2003 | Gates et al. | 224/401 |
| 2004/0000083 | A1 | 1/2004 | Grant, Jr. | |
| 2004/0016169 | A1 | 1/2004 | Poff, Jr. | |
| 2004/0051865 | A1 | 3/2004 | Stierle et al. | |
| 2004/0079018 | A1 | 4/2004 | Holmberg | |
| 2004/0114129 | A1 | 6/2004 | Gogolla et al. | |
| 2004/0135991 | A1 | 7/2004 | Gogolla et al. | |
| 2004/0183942 | A1 | 9/2004 | Holmberg | |
| 2004/0194364 | A1 | 10/2004 | Holmberg | |
| 2004/0257437 | A1 | 12/2004 | Lesseu | |
| 2005/0035245 | A1 | 2/2005 | Morales et al. | |
| 2005/0123883 | A1 | 6/2005 | Kennen et al. | |
| 2005/0195385 | A1 | 9/2005 | Holmberg | |
| 2005/0241210 | A1 | 11/2005 | Karcher et al. | |
| 2005/0246910 | A1 | 11/2005 | Mowers | |
| 2005/0252062 | A1 | 11/2005 | Scrogin et al. | |
| 2005/0268519 | A1 | 12/2005 | Pikielny | |
| 2005/0268521 | A1 | 12/2005 | Cox et al. | |
| 2006/0010761 | A1 | 1/2006 | Staley, III | |
| 2006/0215149 | A1 | 9/2006 | LaBelle et al. | |
| 2007/0008187 | A1 | 1/2007 | Schmidt | |
| 2007/0031142 | A1 | 2/2007 | Moody et al. | |
| 2007/0068018 | A1 | 3/2007 | Gilmore | |
| 2007/0081817 | A1 | 4/2007 | Soulvie | |
| 2007/0125930 | A1 | 6/2007 | Tsai | |
| 2007/0130848 | A1 | 6/2007 | Tsai | |
| 2007/0157502 | A1 | 7/2007 | Holmberg | |
| 2007/0157503 | A1 | 7/2007 | Holmberg | |
| 2007/0277421 | A1 | 12/2007 | Perkins et al. | |
| 2008/0000463 | A1 * | 1/2008 | Holmberg | 124/25 |
| 2008/0000465 | A1 * | 1/2008 | Holmberg | 124/86 |
| 2008/0060248 | A1 | 3/2008 | Pine et al. | |
| 2008/0087784 | A1 * | 4/2008 | Holmberg | 248/309.1 |

FOREIGN PATENT DOCUMENTS

| | | | |
|---|---|---|---|
| GB | 2024558 | A | 1/1980 |
| GB | 2114770 | A | 8/1983 |
| WO | WO9012330 | | 10/1990 |
| WO | WO2006090356 | A1 | 8/2006 |
| WO | WO2006133029 | A2 | 12/2006 |

OTHER PUBLICATIONS

"Specification Sheet on the Impulse 200 LR Laser (Rangefinder)," Nov. 15, 2003, Publisher: Laser Technology Inc.

* cited by examiner

ELECTRONIC DEVICE MOUNT SYSTEM WITH STRAP

BACKGROUND

The present disclosure relates generally to weapons used for hunting. More particularly, the present disclosure relates to an electronic device mount system for weapons.

It is known to attach various electronic devices, such as range finders and video cameras, to weapons. Range finders allow a game hunter to calculate distance to a target and/or bullet drop while video cameras allow a hunter to record a hunt. An electronic device is often attached to a mounting bracket or rail, which is adapted to mount the electronic device to a weapon without impeding use of the weapon.

SUMMARY

An embodiment of the present disclosure is an apparatus for mounting a device on a weapon. The apparatus includes a device support, a weapon mount coupled to the device support, and a removable, stabilizing, elastic strap. The device support has a first side, a second side, and a support surface extending between the first and second sides. The elastic strap has a first end coupled to the first side of the device support, a body extending up and over the device, and a second end coupled to the second side of the device support, wherein the elastic strap secures the device to the device support.

In another embodiment, the apparatus includes a rectangular device support having a support surface defined by a front, a rear, a right side, and a left side. Right and left slots extend into first right and left sides, respectively. The stabilizing strap has a first end for insertion into the right slot, a body extending up and over the device, and a second end for insertion into the left slot. Also, a weapon mount is coupled to device support.

DETAILED DESCRIPTION

An electronic device mounting system can be used to attach electronic devices, such as rangefinders and video cameras, to weapons. In general, the mounting system includes a support portion for resiliently supporting the electronic device and a mounting portion for attaching the support portion and attached electronic device to a weapon. The support portion is universal in that it can be used with a number of interchangeable mounting portions. Each mounting portion is adapted for securing the support portion to a particular type of weapon or weapon accessory. For example, the mounting portion can comprise a bow adaptor, a barrel mount, or a scope mount. Details of the electronic device mounting system are described below with reference to specific, non-limiting embodiments.

Figure 1:
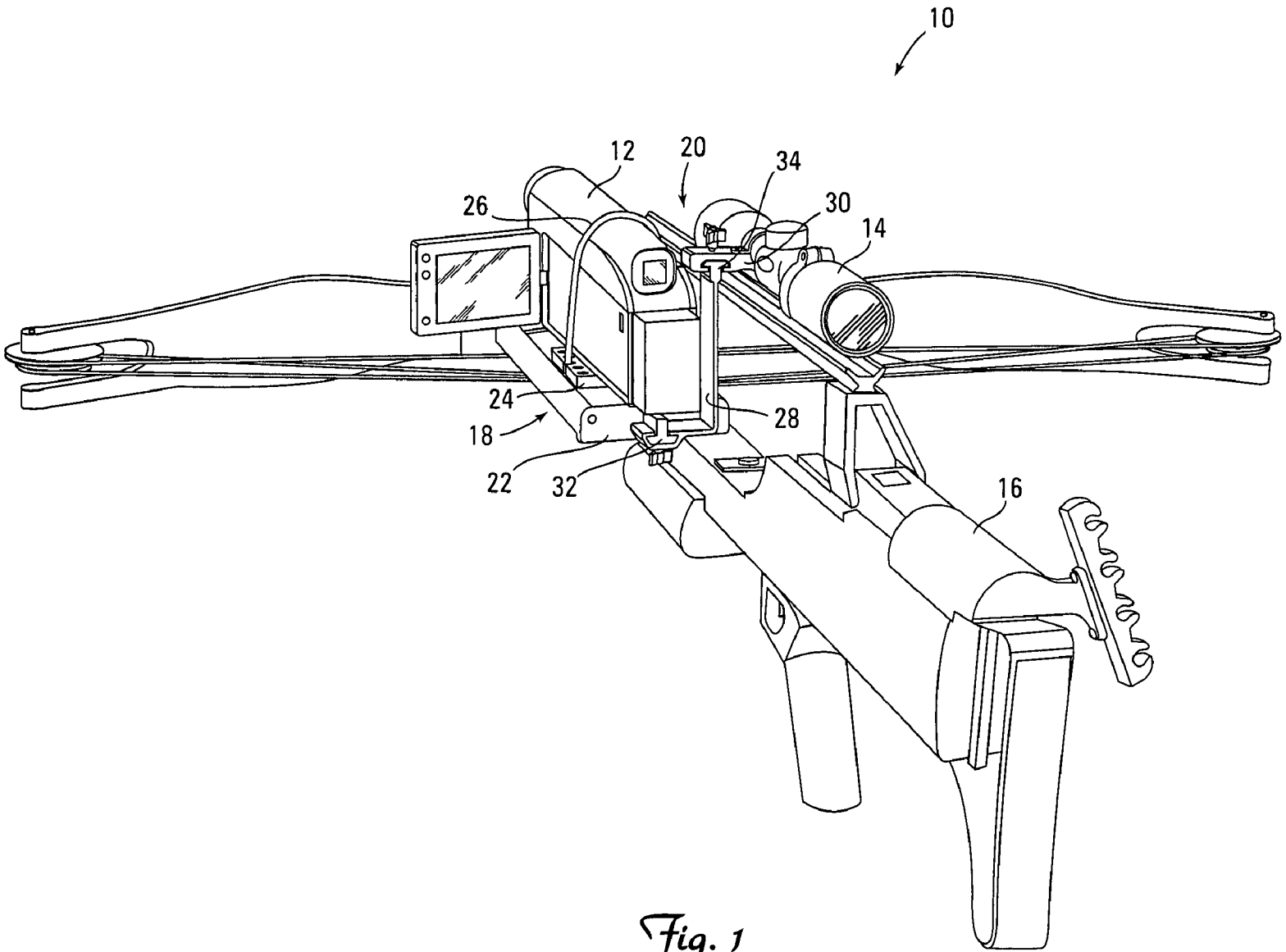
FIG. 1 is a rear perspective view of an electronic device mounting system attaching a video camera to a scope mounted on a crossbow.

FIG. 1 is a rear perspective view of electronic device mounting system 10 attaching video camera 12 to scope 14 mounted on crossbow 16. Electronic device mounting system 10 can be generally divided into support portion 18 and mounting portion 20. Support portion 18 can be further divided into support components: tray 22, carriage 24, and strap 26. Mounting portion 20 can be further divided into mounting components: L-shaped bracket 28, scope mount 30, first connection 32, and second connection 34. Together support portion 18 and mounting portion 20 attach an electronic device, such as video camera 12, to a weapon accessory and/or weapon, such as scope 14 mounted on crossbow 16.

Video camera 12 is attached to support portion 18, which is attached to mounting portion 20, which secures video camera 12 and support portion 18 to scope 14 on crossbow 16. More specifically, video camera 12 is attached to a top surface of carriage 24, which is resiliently mounted in tray 22. A first end of strap 26 is removably attached to a first side of carriage 24 and a second, opposite end of strap 26 is removably attached to a second, opposite side of carriage 26. A central portion of strap located between the first and second ends extends around and secures video camera 12 to carriage 24. L-shaped bracket 28 attaches tray 22 to scope mount 30. L-shaped bracket 28 has a first end forming first connection 32 with a rear end of tray 22 and a second end forming second connection 34 with scope mount 30. Scope mount 30 has a first end surrounding scope 14, which is mounted on crossbow 16, and a second end forming second connection 34 with L-shaped bracket 28. Thus, device mounting system 10 can be used to secure video camera 12 (or another electronic device) to crossbow 16 (or another weapon) for use during game hunting.

Video camera 12 is supported by support portion 18, which is mounted to scope 14 on crossbow 16 by mounting portion 20. L-shaped bracket 28 attached tray 22 to scope mount 30 so that an eyepiece or viewing screen of video camera 12 is located at approximately the same level as eyepiece of scope 14. Video camera 12 is an example of an electronic device suitable for mounting to a weapon, although a still camera, range finder, or any other electronic device is equally possible. Similarly, FIG. 1 shows scope mount 30 surrounding scope 14 on crossbow 16, but electronic device support system 10 is not so limited. As will be appreciated form FIGS. 7 and 9, the present disclosure includes alternative weapons and weapon mounts for use with support system 10.

Figure 2:
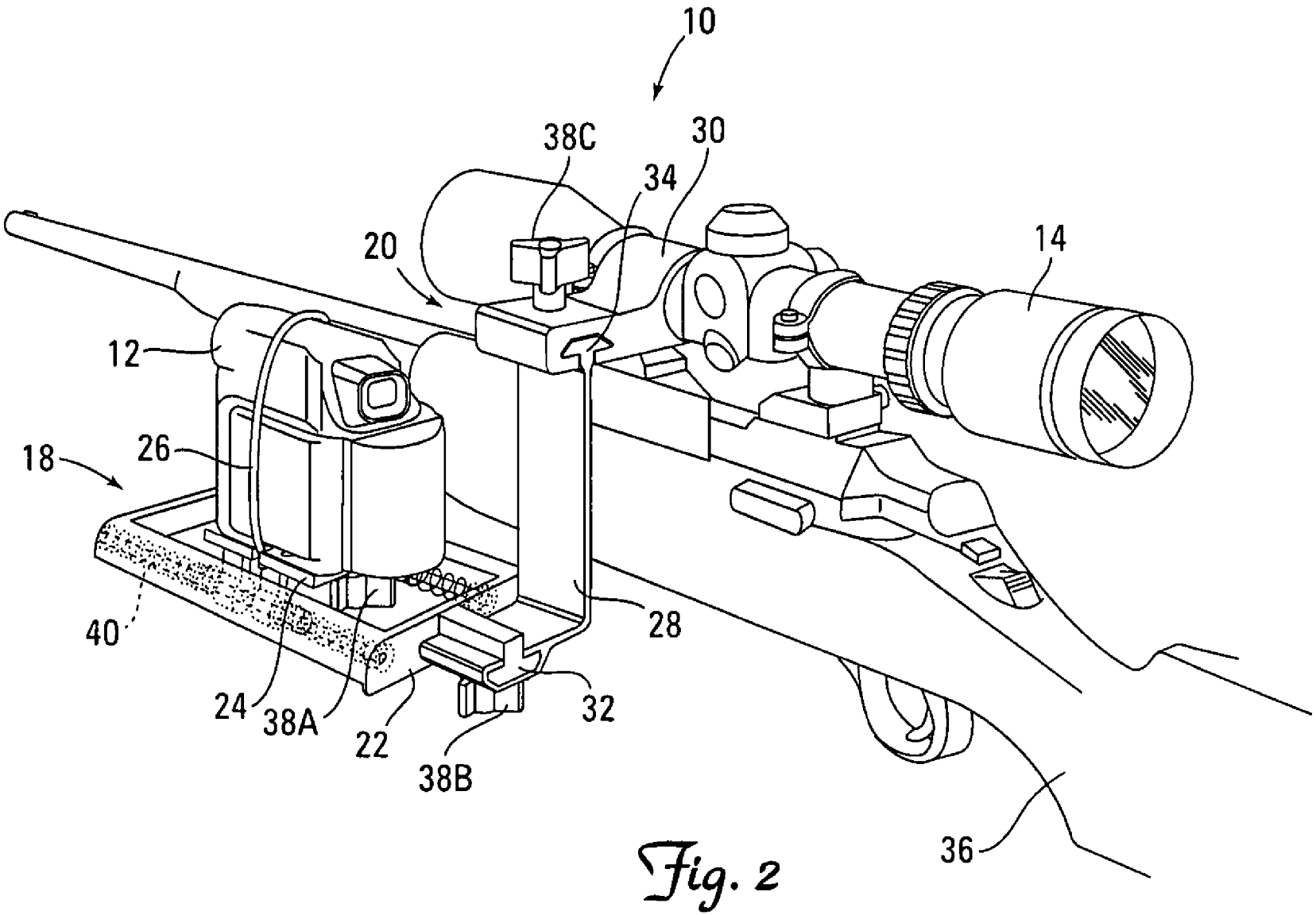
FIG. 2 is a side perspective view of the electronic device mounting system attaching the video camera to the scope mounted on a rifle.

FIG. 2 is a side perspective view of electronic device mounting system 10 attaching video camera 12 to scope 14 mounted on rifle 36. FIG. 2 depicts largely the same components of mounting system 10 as FIG. 1, except scope 14 is mounted on rifle 36 instead of crossbow 16. Also, the locations of screws 38A, 38B, and 38C are identified and damping system 40 located between carriage 24 and tray 22 is shown.

Scope mount 30 has a scope mount ring at a first end for surrounding scope 14. Scope mount 30 has a female connector at a second end for receiving a male connector located at an upper end of L-shaped bracket 28. Together, the female connector of scope mount 30 and the male connector of L-shaped 28 bracket mate to form second connection 34 and secure scope mount 30 to L-shaped bracket 28. Similarly, L-shaped bracket 28 has a female connector at a lower end for receiving a male connector protruding from a rear wall of tray 22. Together, the female connector of L-shaped bracket 28 and the male connector of tray 22 mate to form first connection 32 and secure L-shaped bracket 28 to tray 22. In the depicted embodiment, male and female mating components are T-shaped, although the invention is not so limited and other mating components are contemplated. Screw 38A is located inside of tray 22 and extends upwardly through an aperture in a platform of carriage 24 into a mounting hole in video camera 12. Screw 38B extends upwardly into first connection 32 to secure the mating attachment between tray 22 and L-shaped bracket 28. Screw 38C extends downwardly into second connection 34 to secure the attachment between L-shaped bracket 28 and scope mount 30. Carriage 24 is resiliently coupled to tray 22 by damping system 40, which is described in further detail below with reference to FIG. 3.

Figure 3:
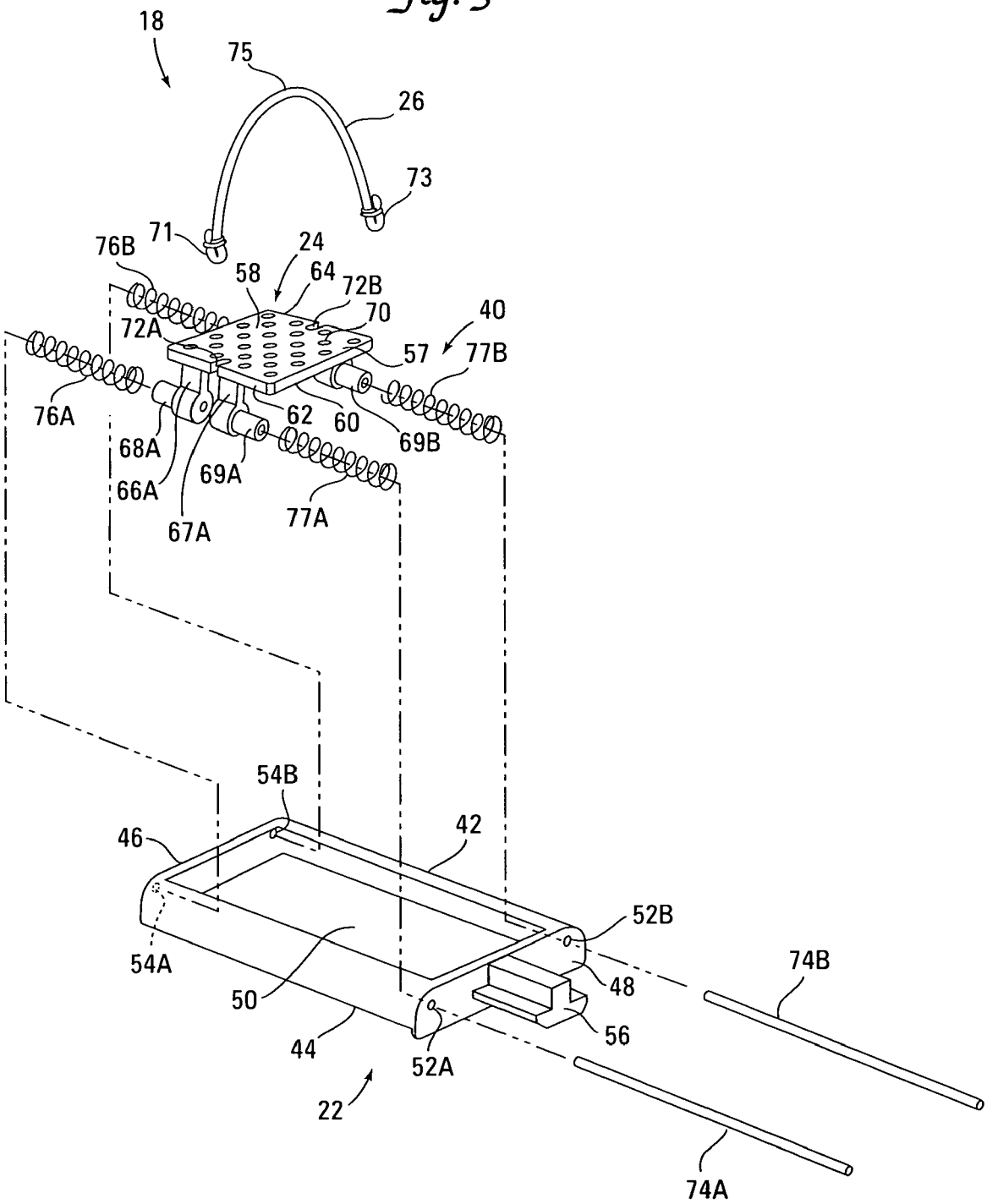
FIG. 3 is an exploded perspective view of a tray, a carriage, a damping system, and a strap for the electronic device mounting system.

FIG. 3 is an exploded perspective view of tray 22, carriage 24, strap 26, and damping system 40 for electronic device mounting system 10. Tray 22 includes top 42, bottom 44, front wall 46, rear wall 48, cavity 50, rod holes 52A, 52B, rod recesses 54A, 54B, and male connector 56. Carriage 24 includes platform 57 having top 58, bottom 60, first side 62, and second side 64. Carriage 24 also includes front legs 66A, 66B, rear legs 67A, 67B front sleeves 68A, 68B, rear sleeves 69A, 69B, apertures 70, and cut-outs 72A, 72B. Strap 26 has first end 71, second end 73, and elongated body 75. Damping system 40 includes rods 74A, 74B, front springs 76A, 76B, and rear springs 77A, 77B. Damping system 40 allows carriage 24 to be movable within, yet securely coupled to, tray 22

Tray 22 is generally rectangular in shape and can comprise plastic. Top 42, bottom 44, front wall 46 and rear wall 48 form a rectangular frame around central opening 50, which extends through an approximate center of tray 22. Circular rod holes 52A, 52B extend through rear wall 48 and are sized to receive rods 74A, 74B. Substantially parallel with rod holes 52A, 52B are rod recesses 54A, 54B, which extend into an inside surface of front wall 46. Rod recesses 54, 54B are also sized to receive rods 74A, 74B. Male connector 56 protrudes from an outside surface of rear wall 48 in between rod holes 52A, 52B. In the depicted embodiment, connector 56 is an upside-down T-shaped male connector for attaching tray 22 to L-shaped bracket 28, although other types of mating connector components are equally possible. Although not visible in FIG. 3, a threaded hole extends upwardly into a bottom surface of connector 56 for receiving screw 38B (see FIG. 2).

Platform 57 is also generally rectangular or square in shape and an entirety of carriage 24 can comprise plastic. A thickness of platform 57 is defined by top 58 and bottom 60 while and a width of platform is defined by first side 62 and second side 64. Front leg 66A and rear leg 67A extend downwardly from first side 62 and form a right angle with bottom 60. Not visible in FIG. 3 are another pair of legs (front leg 66B and rear leg 67B), which extend downwardly from second side 64 and mirror legs 66A, 67A. At a bottom end of legs 66A, 67A are circular sleeves 68A, 69A, respectively. Again, not visible in FIG. 3 are another set of sleeves (68B, 69B) that mirror sleeves 68A, 69A. Sleeves 68A, 69A extend perpendicularly from legs 66A, 67A in a direction away from each other and away from a centerline of carriage 24. A plurality of apertures 70 extend from top 58 to bottom 60 and therefore, through platform 57. Apertures 70 are configured to receive screw 38A, which can extend upwardly through aperture 70 into a mounting hole of an electronic device (such as a tripod screw hole extending into a bottom surface of video camera 12). In the depicted embodiment, apertures 70 are threaded. Also extending from top 58 to bottom 60 are notches or cut-outs 72A, 72B. Cut-outs 72A, 72B are shaped actuate with closed ends and extend into an approximate center of first side 62 and second side 64, respectively. Strap 26 has first end 71, opposite second end 73, and elongated center or body 75 extending between first end 71 and second end 73. In the depicted embodiment, first end 71 and second end 73 are doubled over and bound by a metal crimp such that first and second ends 71, 73 are twice as thick as elongated body 75. In the depicted embodiment strap 26 is elastic and substantially cylindrical like a bungee cord, although other types of cords, straps, or ropes are equally possible. Cut-out 72A is configured to retain first end 71 and cut-out 72B is configured to retain second end 73 of strap 26 so that elongated body 75 can surround and secure an electronic device to top 58 of carriage 24 by exerting a slight downward pressure.

In the depicted embodiment, rods 74A, 74B comprise metal and are cylindrical in shape. Rods 74A, 74B have a length substantially similar to a length of tray 22 and a circumference slightly less than rod holes 52A, 52B, as well as rod recesses 54A, 54B. Springs 76A, 76B, 77A, 77B are slighter larger than rods 74A, 74B so that springs 76A, 77A can surround rod 74A and springs 76B, 77B can surround rod 76B. More specifically, rod 74A is inserted through rod hole 52A and through sleeves 69A and 68B on first side 62 of carriage 24 so that a first end of rod 74A rests in rod recess 54A and a second end of rod 74A rests in rod hole 52A. Spring 76A surrounds rod 74A and is located between front sleeve 68A of carriage 24 and front wall 46 of tray 22. Spring 77A also surrounds rod 74A, but is located between rear sleeve 69A of carriage 24 and rear wall 48 of tray 22. Similarly, rod 74B is inserted through rod hole 52B and through sleeves 68B, 69B on second side 64 of carriage 24 so that a first end of rod 74B rests in rod recess 54B and a second end of rod 74B rests in rod hole 52B. Spring 76B surrounds rod 74B and is located between front sleeve 68B and front wall 46 of tray 22. Spring 77B also surrounds rod 74B, but is located between rear sleeve 69B and rear wall 48 of tray 22. So constructed, damping system 40 resiliently couples carriage 24 with tray 22. Carriage 24 rides rods 74A, 74B between front and rear walls 46, 48 of tray 22. Front springs 76A, 76B absorb impact between carriage 24 and front wall 46 while rear springs 77A, 77B absorb impact between carriage 24 and rear wall 48 of tray 22. Thus, rods 74A, 74B provide a predictable course of movement for carriage 24 and springs 76A, 76B, 77A, 77B absorb shock during weapon recoil and the like.

Figure 4:
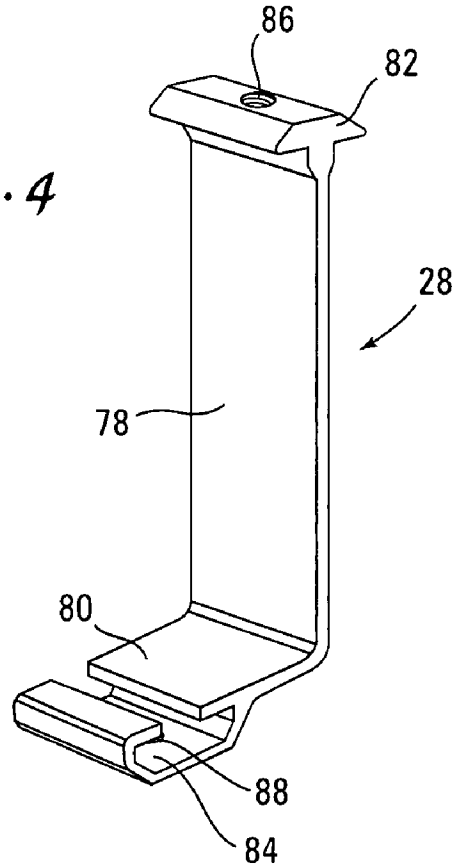
FIG. 4 is a side perspective view of an L-shaped bracket for the electronic device mounting system.

FIG. 4 is a side perspective view of L-shaped bracket 28 for electronic device mounting system 10. L-shaped bracket 28 includes vertical plate 78, horizontal plate 80, male connector 82, female connector 84, threaded bore 86, and threaded hole 88. As indicated by their names, vertical plate 78 extends vertically from one side of horizontal plate 80, which extends horizontally. Located at a top end of vertical plate 78 is T-shaped male connector 82. Upside-down T-shaped female connector 84 is located on an end of horizontal plate 80 opposite vertical plate 78. Threaded bore 86 extends downwardly into an approximate center of male connector 82 and threaded hole 88 extends through an approximate center of female connector 84.

In the depicted embodiment, L-shaped bracket 28 comprises metal. Vertical plate 78 and horizontal plate 80 form an approximately right or 90 degree angle. Male connector 82 is configured for coupling with a female connector to form a connection (such as second connection 34 with scope mount 30 shown in FIG. 2). Female connector 84 is configured for coupling with a male connector to form a connection (such as first connection 32 with tray 22 shown in FIG. 2). Both threaded bore 86 and threaded hole 88 are adapted to receive threaded screws (such as screws 38B and 38C) thereby securing the connections formed. The structure of L-shaped bracket 28 allows for attachment of an electronic device alongside (see FIGS. 1 & 2) or below (see FIG. 7) a weapon. L-shaped bracket 28 strategically positions support portion 18 such that video camera 12 mounted on support portion 18 can capture images of both the weapon and the target. Further, L-shaped bracket 28 is designed to position a viewing screen or eyepiece of video camera 12 mounted to support portion 18 in a location where operator can easily operate both video camera 12 and the weapon more or less simultaneously.

Figure 5:
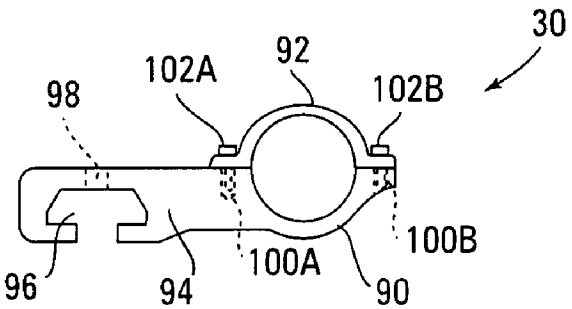
FIG. 5 is a rear view of a scope mount for the electronic device mounting system.

FIG. 5 is a rear view of scope mount 30 for electronic device mounting system 10. Scope mount 30 includes bottom semi-circle 90, top semi-circle 92, arm 94, female connector 96, threaded hole 98, threaded holes 100A, 100B, and screws 102A, 102B. Scope mount 30 can comprise metal. Bottom semi circle 90 has a convex outer surface and a concave inner surface. Likewise, top semi-circle 92 has a convex outer surface and a concave inner surface. Convex surfaces of bottom and top semi-circles 90, 92 face outwardly so that concave surfaces of bottom and top semi-circles 90, 92 face inwardly toward each other. Extending horizontally from one side of bottom semi-circle 90 is arm 94. At a far end of arm 94, opposite bottom semi-circle 90, is downwardly facing female connector 96. Threaded hole 98 extends through a top surface of female connector, and threaded holes 100A, 100B extend downwardly into each side bottom semi-circle 90. Threaded screws 102A, 102B, engage the threads of threaded holes 100A and 100B, respectively, to secure bottom and top semi-circles 90, 92.

Bottom and top semi-circles 90, 92 can be joined around a scope (such as scope 14 in FIGS. 1-2) to form a scope mount ring. Arm 94 extends away from bottom and top semi-circles 90, 92 to place distance between a scope and female connector 96. Female connector 96 is configured to mate with a male connector (such as male connector 82 of L-shaped bracket 28) and form a connection (such as first connection 30 shown in FIG. 1). Threaded hole 98 is intended to receive a screw (such as screw 38C) for securing the connection formed. Similarly, threaded holes 100A, 100B receive threaded screws 102A, 102B, respectively, to secure bottom and top semi-circles 90, 92 around a scope. Scope mount ring 30 attaches support portion 18 and an electronic device (such as video camera 12) to a scope (such as scope 14 shown in FIGS. 1 & 2).

Figure 6:
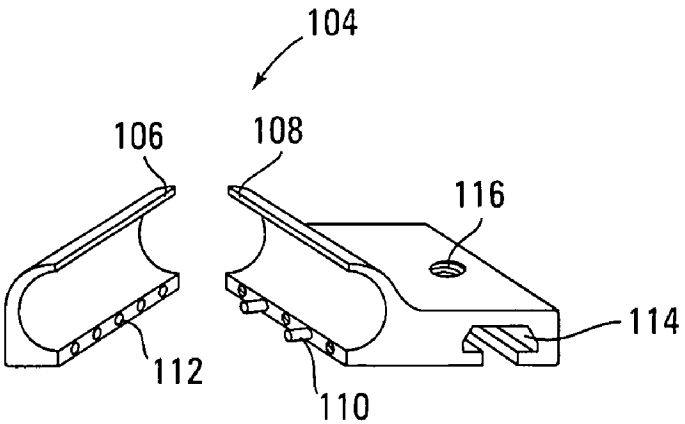
FIG. 6 is an exploded view of a barrel mount for the electronic device mounting system.

FIG. 6 is an exploded view of barrel mount 104 for electronic device mounting system 10. Barrel mount 104 includes left half 106, right half 108, pins 110, pin holes 112, female connector 114, and threaded bore 116. Left half 106 has a convex outer surface and a concave inner surface. Similarly, right half 108 has a convex outer surface and a concave inner surface. When concave surfaces are facing inward, left and right halves 106, 108 are joined to form a cylindrical passage. Pins 110 extend from a bottom inside surface of right half 108 are received into holes 112 located in a bottom inside surface of left half 106, when the left and right halves 106, 108 are joined. Downwardly facing female connector 114 is attached to a side of right half 108 and threaded hole 116 extends downwardly from a top surface into female connector 114.

Instead of using scope mount 30 to attach an electronic device to a scope, barrel mount 104 can be used to attach an electronic device directly to a barrel of a firearm. Left and right halves 106, 108 are joined around the barrel of a firearm so that pins 110 are received into pin holes 112. A small space may extend between tops of left and right halves 106, 108, but a nearly complete cylindrical clamp is formed around the barrel. Female connector 116 is intended to mate with a male connector (such as male connector 82 of L-shaped bracket) and form a connection. Threaded hole 116 is intended to receive a threaded screw for securing the connection formed. Use of barrel mount 104 with electronic device mounting system 10 is described further below.

Figure 7:
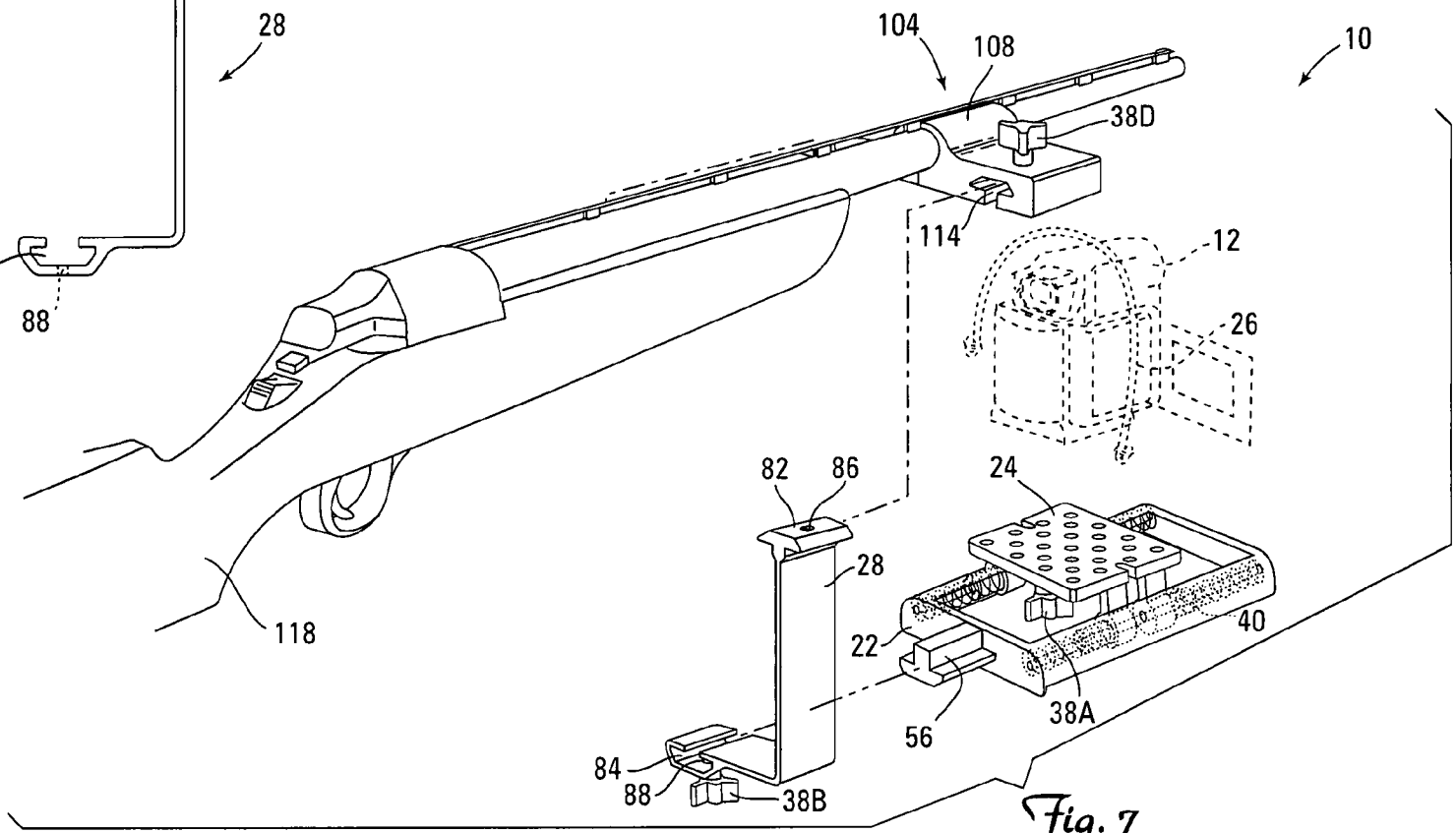
FIG. 7 is an exploded perspective view of the electronic device mounting system attaching a video camera (shown in phantom) to a barrel of a firearm using the barrel mount.
Figure 8:
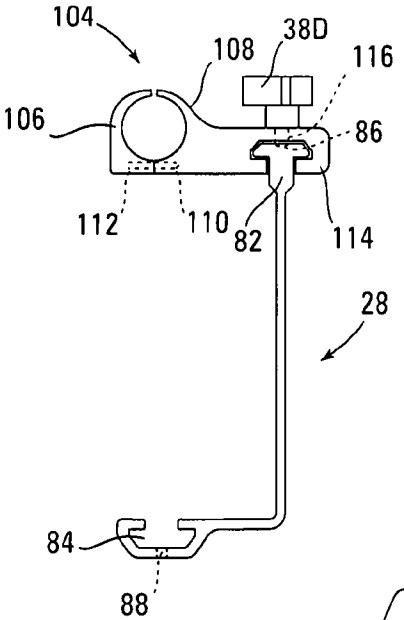
FIG. 8 is a side view of the barrel mount coupled to the L-shaped bracket for the electronic device mounting system.

FIG. 7 is an exploded perspective view and FIG. 8 is a side view of barrel mount 104 coupling with L-shaped bracket 28 to mount video camera 12 (shown in phantom) onto firearm 118 (which may be, for example, a shotgun or rifle). Depicted are video camera 12, tray 22, carriage 24, strap 26, L-shaped bracket 28, screws 38A, 38B, 38D, damping system 40, male connector 82, female connector 84, threaded bore 86, threaded hole 88, barrel mount 104, left side 106, right side 108, pin 110, pin hole 112, female connector 114, threaded hole 116, and firearm 118. Mostly, the components of electronic device mounting system 10 such as, video camera 12, tray 22, carriage 24, strap 26, L-shaped bracket 28, screws 38A, 38B, damping system 40, male connector 82, female connector 84, threaded bore 86, and threaded hole 88 are arranged and functioning as described above. The distinction of FIG. 7 being use of barrel mount 104 to secure video camera 12 below the barrel of firearm 118.

L-shaped bracket 28 is located below barrel mount 104 so that male connector 82 couples with female connector 114. Screw 38D extends down through threaded hole 116 and into threaded bore 86 to secure the connection between L-shaped bracket 28 and barrel mount 104. Left and right sides 106, 108 of barrel mount 104 substantially surround the barrel of firearm 118 so that L-shaped bracket 28 depends downwardly along a right side of firearm 118 and carriage 24, tray 22, and video camera 12 are located below firearm 118. So assembled, video camera 12 is capable of capturing the barrel and the target in a single image while being securely and resiliently mounted on firearm 118 with electronic device mounting system 10.

Figure 9:
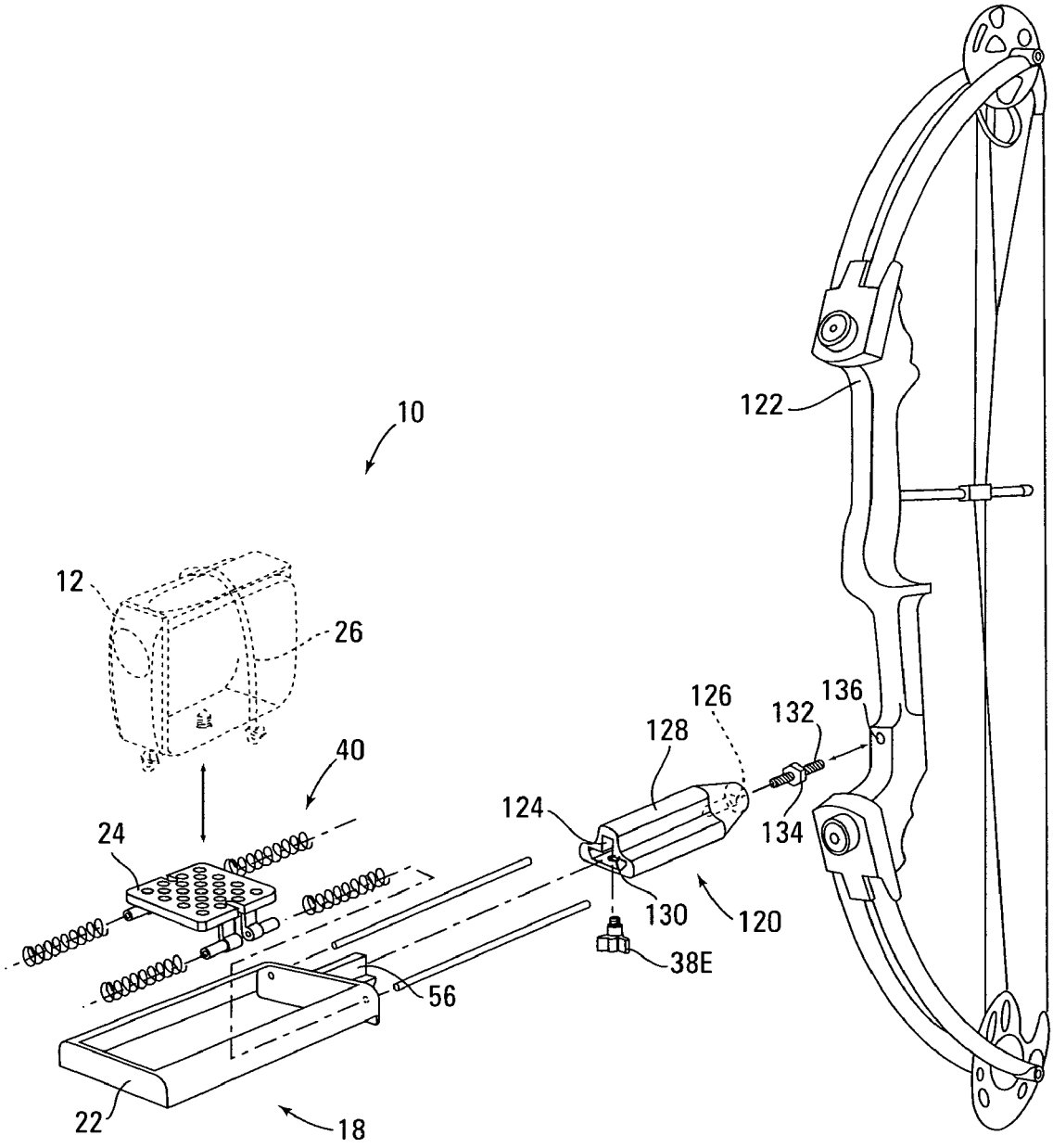
FIG. 9 is an exploded perspective view of the electronic device mounting system attaching a video camera (shown in phantom) to a stabilizer hole in a bow using a bow adapter.

FIG. 9 is an exploded perspective view of electronic device mounting system 10 having bow adaptor 120 for attaching video camera 12 to bow 122. Depicted are components of electronic device mounting system 10 described in detail above: video camera 12, support portion 18, tray 22, carriage 24, strap 26, screw 38E, damping system 40, and male connector 56. Distinguishing the system of FIG. 9 are bow adapter 120 and bow 122. Bow adaptor 120 includes female connector 124, threaded bore 126, body 128, threaded hole 130, screw 132, and washer 134. Front surface of bow 122 includes threaded aperture 136 so that bow adaptor 120 can mount support portion 18 out in front of bow 122.

Bow adaptor 120 has female connector 124 at a first, forward end, threaded bore 126 at a second, rearward end, and elongated body 128 extending between female connector 124 and threaded bore 126. Body 128 is T-shaped toward female connector 124 and cone-shaped toward threaded bore 126. Extending upwardly into a bottom surface of body 128 near female connector 124 is threaded hole 130. Screw 132 has threads on both ends and washer 34 is threaded onto threaded screw 132. Female connector 124 is configured to directly receive male connector 56 protruding from tray 22 thereby forming a connection between mounting portion 18 and bow adaptor 120. Threaded screw 38E extends upwardly through threaded hole 130 and into a threaded aperture on a bottom of male connector 56 to secure the connection between bow adaptor 120 and tray 22. Washer 134 is threaded onto an approximate center of screw 132. A first end of screw 132 engages threads in threaded bore 126 and a second end of screw 132 engages threads in threaded aperture 136 of bow 122, so that washer 134 is located between bow adapter 120 and bow 122. So assembled, bow adaptor 120 mounts support portion 18 and video camera 12 out in front of bow 122 so that electronic device mounting system 10 acts as a stabilizing bar providing stabilization to bow 122.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An apparatus for mounting a device on a weapon, the apparatus comprising:

a carriage having a first side, a second side, a flat support surface extending between the first and second sides, and first and second legs extending downwardly from the first and second sides of the carriage, respectively;

a tray having a bottom, four walls extending upwardly from the bottom and defining a central cavity, and a shock absorbing system including rods and springs located in the cavity, the carriage being movable within the cavity and securely coupled to the tray by cooperation between the first and second legs and the rods of the shock absorbing system;

a weapon mount attached to the tray; and a removable, stabilizing, elastic strap having a first end coupled to the first side of the carriage, a body extending up and over the device, and a second end coupled to the second side of the carriage, wherein the elastic strap secures the device to the carriage.

2. The apparatus of claim 1, wherein the elastic strap comprises a substantially cylindrical cord.

3. The apparatus of claim 2, wherein the first and second ends are doubled to increase end size.

4. The apparatus of claim 3, wherein a diameter of the body is approximately half a diameter of the first and second ends.

5. The apparatus of claim 4, further comprising:

first and second wires surrounding the doubled first and second ends, respectively.

6. The apparatus of claim 1, further comprising:

a first slot extending into the first side of the support surface and a second slot extending into the second side of the support surface, wherein the first and second ends are retained by the first and second slots, respectively.

7. The apparatus of claim 6, wherein the carriage extends vertically upwards from its attachment to the tray.

8. The apparatus of claim 7, wherein the first and second legs extend perpendicularly from the first and second sides of the carriage, respectively.

9. The apparatus of claim 8, further comprising:

third and fourth legs extending perpendicularly from the first and second sides of the carriage, respectively, wherein the first slot is located between the first and third legs and the second slot is located between the second and fourth legs.

10. The apparatus of claim 1, further comprising:

a plurality of attaching apertures extending through the support surface.

11. The apparatus of claim 1, wherein one of the springs is located between the first leg of the carriage and one of the four walls of the tray.

12. An apparatus for mounting a device on a weapon, the apparatus comprising:

a rectangular carriage having a flat support surface defined by a front, a rear, a right side, and a left side, the carriage including legs extending perpendicularly from the first and second right and left sides;

right and left slots extending into the right and left sides, respectively;

a stabilizing strap having a first end for insertion into the right slot, a body extending up and over the device, and a second end for insertion into the left slot;

a tray having a cavity defined by a bottom and four upstanding walls, and a shock absorbing system located within the cavity, the shock absorbing system including rods and springs, the carriage being movable within the cavity and securely coupled to the tray by an interaction between the first and second legs and the rods of shock absorbing system; and a weapon mount attached to one of the four upstanding walls of the tray.

13. The apparatus of claim 12, further comprising:

a plurality of attaching apertures extending through the support surface.

14. The apparatus of claim 12, wherein the carriage comprises plastic.

15. The apparatus of claim 12, wherein the slots have an arcuate-shaped closed end.

16. The apparatus of claim 15, wherein the stabilizing strap comprises a substantially cylindrical and elastic cord.

17. The apparatus of claim 16, wherein the first and second ends have a diameter larger than a diameter of the body such that the first and second ends are secured to the carriage when inserted through the right and left slots, respectively.

18. The apparatus of claim 12, wherein the first and second ends are turned back on themselves such that the first and second ends are twice as thick as the body.

19. The apparatus of claim 12, wherein the first and second ends are bound by first and second wires, respectively.

20. The apparatus of claim 12, wherein one of the springs is located between the first leg of the carriage and one of the four upstanding walls of the tray.

* * * * *